US010495035B2

(12) United States Patent
Gukelberger et al.

(10) Patent No.: US 10,495,035 B2
(45) Date of Patent: Dec. 3, 2019

(54) DEDICATED EXHAUST GAS RECIRCULATION CONFIGURATION FOR REDUCED EGR AND FRESH AIR BACKFLOW

(71) Applicant: Southwest Research Institute, San Antonio, TX (US)

(72) Inventors: Raphael Gukelberger, San Antonio, TX (US); Steven H. Almaraz, Seguin, TX (US)

(73) Assignee: Southwest Research Institute, San Antonio, TX (US)

( * ) Notice: Subject to any disclaimer, the term of this patent is extended or adjusted under 35 U.S.C. 154(b) by 178 days.

(21) Appl. No.: 15/426,623

(22) Filed: Feb. 7, 2017

(65) Prior Publication Data

US 2018/0223777 A1 Aug. 9, 2018

(51) Int. Cl.

| | |
|---|---|
| ***F02M 26/21*** | (2016.01) |
| ***F02M 26/43*** | (2016.01) |
| ***F02M 26/39*** | (2016.01) |
| *F02M 35/104* | (2006.01) |

(52) U.S. Cl.

CPC ..... *F02M 26/21* (2016.02); *F02M 26/39* (2016.02); *F02M 26/43* (2016.02); *F02M 35/104* (2013.01)

(58) Field of Classification Search

CPC ..... F02M 26/21; F02M 26/43; F02M 26/39; F02M 35/104

See application file for complete search history.

(56) References Cited

U.S. PATENT DOCUMENTS

| | | | |
|---|---|---|---|
| 1,563,608 | A | 12/1925 | Wood |
| 2,113,602 | A | 4/1938 | Pratt |
| 3,156,162 | A | 11/1964 | Wallace et al. |
| 3,228,183 | A | 1/1966 | Feller |
| 3,303,831 | A | 2/1967 | Sherman |
| 3,405,679 | A | 10/1968 | Norris et al. |
| 3,405,697 | A | 10/1968 | Marchand |
| 3,680,534 | A | 8/1972 | Chavant |
| 3,805,752 | A | 4/1974 | Cataldo |
| 3,924,576 | A | 12/1975 | Siewert |

(Continued)

FOREIGN PATENT DOCUMENTS

| | | |
|---|---|---|
| FR | 2173555 A5 | 10/1973 |
| GB | 1378132 | 12/1974 |

(Continued)

OTHER PUBLICATIONS

International Search Report (dated Oct. 2, 2006) issued in International Patent Application No. PCT/US05/40483. (WO2006052993) (5 pgs).

(Continued)

*Primary Examiner* — Xiao En Mo

(74) *Attorney, Agent, or Firm* — Grossman, Tucker, Perreault & Pfleger, PLLC

(57) ABSTRACT

A dedicated exhaust gas recirculation configuration that provides reduced exhaust gas recirculation (EGR) backflow and reduced fresh air backflow. One-way valves are positioned in the EGR loop to reduce or avoid fresh-air backflow into the dedicated exhaust gas recirculating cylinder and/or positioned in the engine intake passage to reduce or avoid dedicated cylinder exhaust gas backflow into the intake passage.

12 Claims, 8 Drawing Sheets

(56) References Cited

U.S. PATENT DOCUMENTS 3,941,113 A 3/1976 Bauelin
3,958,540 A 5/1976 Siewert
3,963,000 A 6/1976 Kosaka et al.
4,004,554 A 1/1977 Kosaka et al.
4,108,114 A 8/1978 Kosaka et al.
4,179,892 A 12/1979 Heydrich
4,201,180 A 5/1980 Iizuka
4,224,912 A 9/1980 Tanaka
4,291,535 A 9/1981 Goloff
4,350,133 A 9/1982 Greiner
4,783,966 A 11/1988 Aldrich
4,843,821 A 7/1989 Paul et al.
5,056,314 A 10/1991 Paul et al.
5,178,119 A 1/1993 Gale
5,207,714 A 5/1993 Hayashi et al.
5,257,600 A 11/1993 Schechter et al.
5,297,515 A 3/1994 Gale et al.
5,343,699 A 9/1994 McAlister
5,379,728 A 1/1995 Cooke
5,456,240 A 10/1995 Kanesaka
5,515,814 A 5/1996 Cooke
5,517,976 A 5/1996 Bachle et al.
5,524,582 A 6/1996 Suh et al.
5,562,085 A 10/1996 Kosuda et al.
5,806,315 A 9/1998 Mui
5,847,470 A 12/1998 Mitchell
5,894,726 A 4/1999 Monnier
6,009,709 A 1/2000 Bailey
6,138,650 A 10/2000 Bailey
6,178,956 B1 1/2001 Steinmann et al.
6,216,458 B1 4/2001 Alger et al.
6,286,489 B1 9/2001 Bailey
6,343,594 B1 2/2002 Koeslin et al.
6,425,381 B1 7/2002 Rammer
6,478,017 B2 11/2002 Bianchi
6,484,702 B1 11/2002 Riley
6,536,392 B2 3/2003 Widener
6,543,230 B1 4/2003 Schmid
6,543,411 B2 4/2003 Raab et al.
6,609,374 B2 8/2003 Feucht et al.
6,655,324 B2 12/2003 Cohn et al.
6,672,292 B2 1/2004 Fischer
6,742,507 B2 6/2004 Keefer et al.
6,789,531 B1 9/2004 Remmels
6,820,415 B2 11/2004 Abet et al.
6,871,642 B1 3/2005 Osterwald
6,877,464 B2 4/2005 Hitomi et al.
6,877,492 B1 4/2005 Osterwald
6,915,776 B2 7/2005 zur Loye et al.
6,918,251 B2 7/2005 Yanagisawa et al.
6,923,149 B2 8/2005 Nishimoto et al.
6,945,235 B1 9/2005 Bertilsson et al.
7,028,680 B2 4/2006 Liu et al.
7,032,578 B2 4/2006 Liu et al.
7,140,357 B2 11/2006 Wei et al.
7,168,250 B2 1/2007 Wei et al.
7,232,553 B2 6/2007 Oh et al.
7,261,064 B2 8/2007 Bhaisora et al.
7,287,378 B2 10/2007 Chen et al.
7,290,504 B2 11/2007 Lange
7,384,620 B2 6/2008 Bowman et al.
7,389,770 B2 6/2008 Bertilsson et al.
7,648,785 B2 1/2010 Hu et al.
7,721,541 B2 5/2010 Roberts, Jr. et al.
7,757,677 B2 7/2010 Dobrila
7,779,823 B2 8/2010 Winstead
7,801,664 B2 9/2010 Winstead
7,818,959 B2 10/2010 Hu et al.
7,945,376 B2 5/2011 Geyer et al.
7,945,377 B1 5/2011 Van Nieuwstadt et al.
8,100,093 B2 1/2012 Morgenstern
8,291,891 B2 10/2012 Alger, II et al.
8,311,723 B2 11/2012 McAlister
8,387,593 B2 3/2013 Ichihara et al.
8,463,529 B2 6/2013 Hu
8,557,458 B2 10/2013 Scotto et al.
8,561,599 B2 10/2013 Gingrich et al.
8,668,752 B2 3/2014 Scotto et al.
8,695,540 B2 4/2014 Minick
8,752,532 B2 6/2014 Korenaga et al.
8,838,367 B1 9/2014 McAlister
8,893,687 B2 11/2014 Gingrich et al.
8,904,786 B2 12/2014 Hayman
8,944,034 B2 2/2015 Gingrich et al.
8,966,896 B2 3/2015 Jacques et al.
9,083,020 B2 7/2015 Scotto
9,091,204 B2 7/2015 McAlister
9,118,048 B2 8/2015 Scotto
9,140,220 B2 9/2015 Scotto
9,145,837 B2 9/2015 Klingbeil
9,169,773 B2 10/2015 Bromberg et al.
9,178,235 B2 11/2015 Scotto et al.
9,206,769 B2 12/2015 Burrahm
9,255,560 B2 2/2016 McAlister
9,297,320 B2 3/2016 Hilditch et al.
9,328,697 B2 5/2016 Peters et al.
9,377,105 B2 6/2016 McAlister
9,464,584 B2 10/2016 Gingrich et al.
9,574,487 B2 2/2017 Gruber et al.
9,611,794 B2 4/2017 Blythe et al.
9,874,193 B2 1/2018 Gukelberger et al.
10,125,726 B2 11/2018 Henry
2001/0015193 A1 8/2001 Tanaka et al.
2002/0189598 A1 12/2002 Remmels
2003/0121484 A1 7/2003 Wang
2004/0074480 A1* 4/2004 Chen ..... F02M 26/43 123/568.12
2004/0099256 A1 5/2004 Stewart
2005/0016792 A1 1/2005 Graefenstein
2005/0022450 A1 2/2005 Tan et al.
2006/0059896 A1 3/2006 Liu et al.
2006/0070587 A1 4/2006 Bhalsora et al.
2006/0112940 A1 6/2006 Roberts, Jr. et al.
2007/0028901 A1 2/2007 Watakabe et al.
2007/0175215 A1* 8/2007 Rowells ..... F02B 29/0418 60/605.2
2007/0193270 A1 8/2007 Roozenboom et al.
2009/0120385 A1 5/2009 Munshi et al.
2009/0199825 A1 8/2009 Piper et al.
2009/0308070 A1 12/2009 Alger, II et al.
2010/0024416 A1* 2/2010 Gladden ..... F02B 37/001 60/605.2
2010/0024417 A1* 2/2010 Pierpont ..... F01N 13/107 60/605.2
2010/0162994 A1* 7/2010 Elsa er ..... F02B 29/083 123/337
2011/0041495 A1 2/2011 Yager
2012/0006288 A1 1/2012 Winstead
2012/0078492 A1 3/2012 Freund et al.
2012/0090581 A1* 4/2012 De Almeida ..... F02M 26/19 123/568.11
2012/0097138 A1 4/2012 Keating
2012/0167863 A1 7/2012 Kulkarni
2012/0204844 A1 8/2012 Gingrich et al.
2012/0204845 A1 8/2012 Gingrich et al.
2012/0216530 A1 8/2012 Flynn et al.
2013/0000320 A1 1/2013 McKenna et al.
2013/0030672 A1 1/2013 Klingbeil
2013/0133616 A1 5/2013 Klingbeil
2013/0216473 A1 8/2013 Nicole et al.
2013/0323145 A1 12/2013 Tran et al.
2014/0196697 A1 7/2014 Burrahm
2014/0196702 A1 7/2014 Gingrich et al.
2014/0261322 A1 9/2014 Geckler et al.
2014/0331668 A1 11/2014 Bidner et al.
2014/0331970 A1 11/2014 Bidner et al.
2015/0107227 A1* 4/2015 Carlsson ..... F02D 41/008 60/274
2015/0337696 A1* 11/2015 Glugla ..... F02D 41/003 123/574
2015/0361927 A1 12/2015 Glugla
2016/0017847 A1 1/2016 Hilditch et al.
2016/0076488 A1 3/2016 Henry

(56) References Cited

U.S. PATENT DOCUMENTS

| | | | | |
|---|---|---|---|---|
| 2016/0237928 | A1* | 8/2016 | Lana | F02D 13/02 |
| 2016/0245239 | A1 | 8/2016 | Henry | |
| 2017/0363057 | A1 | 12/2017 | Gukelberger et al. | |

FOREIGN PATENT DOCUMENTS

| | | | | |
|---|---|---|---|---|
| GB | 2110791 | A | 11/1982 | |
| JP | 11247665 | A | 9/1999 | |
| JP | 2004278433 | A | 10/2004 | |
| JP | 2005-054605 | A | 3/2005 | |
| JP | 2006-336465 | A | 12/2006 | |
| JP | 2011099375 | A | 5/2011 | |
| WO | 2000071881 | A1 | 11/2000 | |
| WO | 2006052993 | A2 | 5/2006 | |
| WO | WO-2010037540 | A1 * | 4/2010 | F02M 26/05 |
| WO | 2010146048 | A1 | 12/2010 | |

OTHER PUBLICATIONS

International Preliminary Report on Patentability/Written Opinion (dated Oct. 2, 2006) issued in International Patent Application No. PCT/US05/40483. (WO2006052993) (7 pgs).

U.S. Office Action dated May 28, 2013 issued in related U.S. Appl. No. 13/025,901 (17 pgs.).

U.S. Office Action dated Dec. 12, 2013 issued in related U.S. Appl. No. 13/025,901 (16 pgs.).

U.S. Office Action dated May 21, 2014 issued in related U.S. Appl. No. 13/025,901 (15 pgs.).

U.S. Office Action dated Mar. 22, 2013 issued in related U.S. Appl. No. 13/025,912 (6 pgs.).

U.S. Office Action dated Jun. 27, 2016 issued in U.S. Appl. No. 14/631,384 (12 pgs).

U.S. Office Action dated May 1, 2017 issued in U.S. Appl. No. 14/631,384 (13 pgs).

U.S. Office Action dated Oct. 18, 2017 issued in U.S. Appl. No. 14/631,384 (9 pgs).

Caterpillar "Application and Installation Guide, Gas Engine Emissions"; © 2007 Caterpillar® (31 pgs).

Duel Fuel™ Technology, Clean Air Power; "Dual-Fuel vs Spark Ignition"; <<http://www.cleanairpower.com/dualfuelvssparkignition.html>>; (2 pgs) (accessed Oct. 2, 2017).

Hacarlioglu, et al; "Studies of the Methane Steam Reforming Reaction at High Pressure in a Ceramic Membrane Reactor"; Abstract only—accessed Sep. 15, 2015 <<http://www.sciencedirect.com/science/article/pii/S100399530660011X>>.

Hankinson, et al; Ignition Energy and Ignition Probability of Methane-Hydrogen-Air Mixtures; accessed May 30, 2013 <<http://conference.ing.unipi.it/ichs/images/stories/papers/125.pdf>>.

Saxena, et al; "The Influence of Hydrogen and Carbon Monoxide on Structure and Burning Velocity of Methane Flames"; 2009 Fall Technical Meeting of the Western States Section of the Combusion Institute Hosted by the Univ of Cali at Irvine, CA, Oct. 26-27, 2009, Paper #09F-86, 20 pgs; accessed May 20, 2015 <<http://www.engr.ucr.edu/WSSCIConference/Exampleformat.pdf>>.

Wu, H. et al., "Ni-Based Catalysts for Low Temperature Methane Stream Reforming: Recent Results on Ni-Au and Comparison with Other Bi-Metallic Systems", Catalysts 2013, vol. 3, pp. 563-583.

Zanfir, et al; Catalytic Combustion Assisted Methane Steam Reforming in a Catalytic Plate Reactor; Chemical Engineering Science vol. 58, pp. 3947-3960, 2003.

* cited by examiner

DEDICATED EXHAUST GAS RECIRCULATION CONFIGURATION FOR REDUCED EGR AND FRESH AIR BACKFLOW

FIELD

The present invention provides a dedicated exhaust gas recirculation configuration that provides reduced exhaust gas recirculation (EGR) backflow and reduced fresh air backflow. More specifically, a one-way valve is positioned in the EGR loop to reduce or avoid fresh-air backflow into the dedicated exhaust gas recirculating cylinder and/or in the engine intake passage to reduce or avoid dedicated cylinder exhaust gas backflow into the intake passage.

BACKGROUND

For certain conventional exhaust gas recirculation (EGR) systems, exhaust gas expelled from all of the cylinders of an internal combustion engine may be collected in an exhaust manifold. A fraction of the collected exhaust gas (e.g. 5% to 10%) may then be routed from the exhaust manifold through a control valve back to an intake manifold of the engine, where it may be introduced to a stream of fresh (ambient) intake air. The remaining fraction of exhaust gas in the exhaust manifold, rather than being recirculated and recycled, generally flows to a catalytic converter of the exhaust system and, after treatment therein, may be expelled to the atmosphere through the exhaust pipe.

EGR has a history of use in gasoline spark-ignition engines, and affects combustion in several ways. First, the combustion in the cylinders of the engine may be cooled by the presence of exhaust gas, that is, the recirculated exhaust gas may absorb heat from the combustion. Furthermore, the dilution of the oxygen present in the combustion chamber with the exhaust gas, in combination with the cooler combustion, may reduce the production of mono-nitrogen oxides (NOx), such as nitric oxide (NO) and nitrogen dioxide ($NO_2$). Additionally, EGR may reduce the need for fuel enrichment at high loads in turbocharged engines and thereby improve fuel economy.

EGR which uses higher levels of exhaust gas may further increase fuel efficiency and reduce emissions of spark-ignition engines. However, with higher levels of exhaust gas, engines may face challenges related to EGR tolerance, which may reduce the expected fuel efficiency improvement. Challenges related to EGR tolerance may be understood to include increasing an engine's ability to process higher levels of exhaust gas without adversely affecting performance, particularly fuel economy. Thus, even if EGR tolerance may be satisfactory for engine operation at low levels of EGR, an engine may need additional modifications in structure and operational conditions to accommodate higher levels of EGR without adversely affecting engine performance.

More recently, an engine configuration has been proposed with one or more cylinders of the engine being dedicated to expelling exhaust gas for EGR, which is then directed to the intake manifold. Such cylinders may be referred to as dedicated EGR, or D-EGR, cylinders. Dedicated EGR cylinder(s) may operate at a broad range of equivalence ratios since their exhaust gas is generally not configured to exit the engine before flowing through a cylinder operating at, for example, a stoichiometric or near stoichiometric air/fuel ratio. This may allow the dedicated EGR cylinder to be operated fuel rich to produce higher levels of hydrogen ($H_2$) gas and carbon monoxide (CO) gas and which, may in turn, increase the octane number and promote increased EGR tolerance and knock tolerance by increasing flame/speed burn rates, as well as increasing the dilution limits of the mixture and associated combustion stability of all the cylinders. Examples of engines with a D-EGR cylinder may be found in U.S. Patent Application Publication No. 2012/0204844 entitled "Dedicated EGR Control Strategy For Improved EGR Distribution And Engine Performance" and U.S. Patent Application Publication No. 2012/0204845 entitled "EGR Distributor Apparatus For Dedicated EGR Configuration."

SUMMARY

An internal combustion engine comprising an air intake passage in communication with an intake manifold including a plurality of cylinders, at least one of the cylinders arranged as a dedicated exhaust gas recirculation cylinder, wherein a volume of exhaust gas expelled from the dedicated exhaust gas cylinder is capable of recirculating via an exhaust gas recirculation loop to the intake manifold, including a one-way valve positioned in either of the air intake passage or the exhaust gas recirculation loop, or in both the air-intake passage and exhaust gas recirculation loop. When the one way valve is positioned in the air intake passage the valve is capable of restricting the flow of exhaust gas from the exhaust gas recirculation loop into the air intake passage. When the one-way valve is positioned in the exhaust gas recirculation loop the valve is capable of restricting the flow of air from the air intake passage into the exhaust gas recirculation loop.

The present invention also relates to an internal combustion engine comprising an air intake passage in communication with an intake manifold including a plurality of cylinders, at least one of the cylinders arranged as a dedicated exhaust gas recirculation cylinder, wherein a volume of exhaust gas expelled from the dedicated exhaust gas cylinder is capable of recirculating via an exhaust gas recirculation loop to the intake manifold, including a one-way valve positioned in said air intake passage and said exhaust gas recirculation loop. The one way valve positioned in the air intake passage is capable of restricting 0-10% by volume of exhaust gas from the exhaust gas recirculation loop from flowing into the air intake passage and the one-way valve positioned in the exhaust gas recirculation loop is capable of restricting 0-10% by volume of air from the air intake passage from flowing into the exhaust gas recirculation loop.

In method form, the present invention comprises a method of operating an internal combustion engine having a plurality of cylinders, an air-intake passage and an exhaust gas recirculation loop, including a one-way valve positioned in either of said air-intake passage or said exhaust gas recirculation loop. The method then comprises operating one or more of the cylinders as a non-dedicated exhaust gas recirculating cylinder which non-dedicated exhaust gas cylinder(s) is in communication with said air-intake passage and operating one or more cylinders as a dedicated exhaust gas recirculating cylinder(s) wherein said operation provides exhaust gas output that is connected to said exhaust gas recirculation loop. The one way valve positioned in said air intake passage is operated to restrict the flow of exhaust gas from the exhaust gas recirculation loop into the air intake passage and the one-way valve positioned in said exhaust gas recirculation loop is operated to restrict the flow of air from said air intake passage into the exhaust gas recirculation loop.

FIGURES

The above-mentioned and other features of this invention and the manner of attaining them will become more apparent with reference to the following description of embodiments herein taking in conjunction with the accompanying drawings, wherein.

Figure 3:
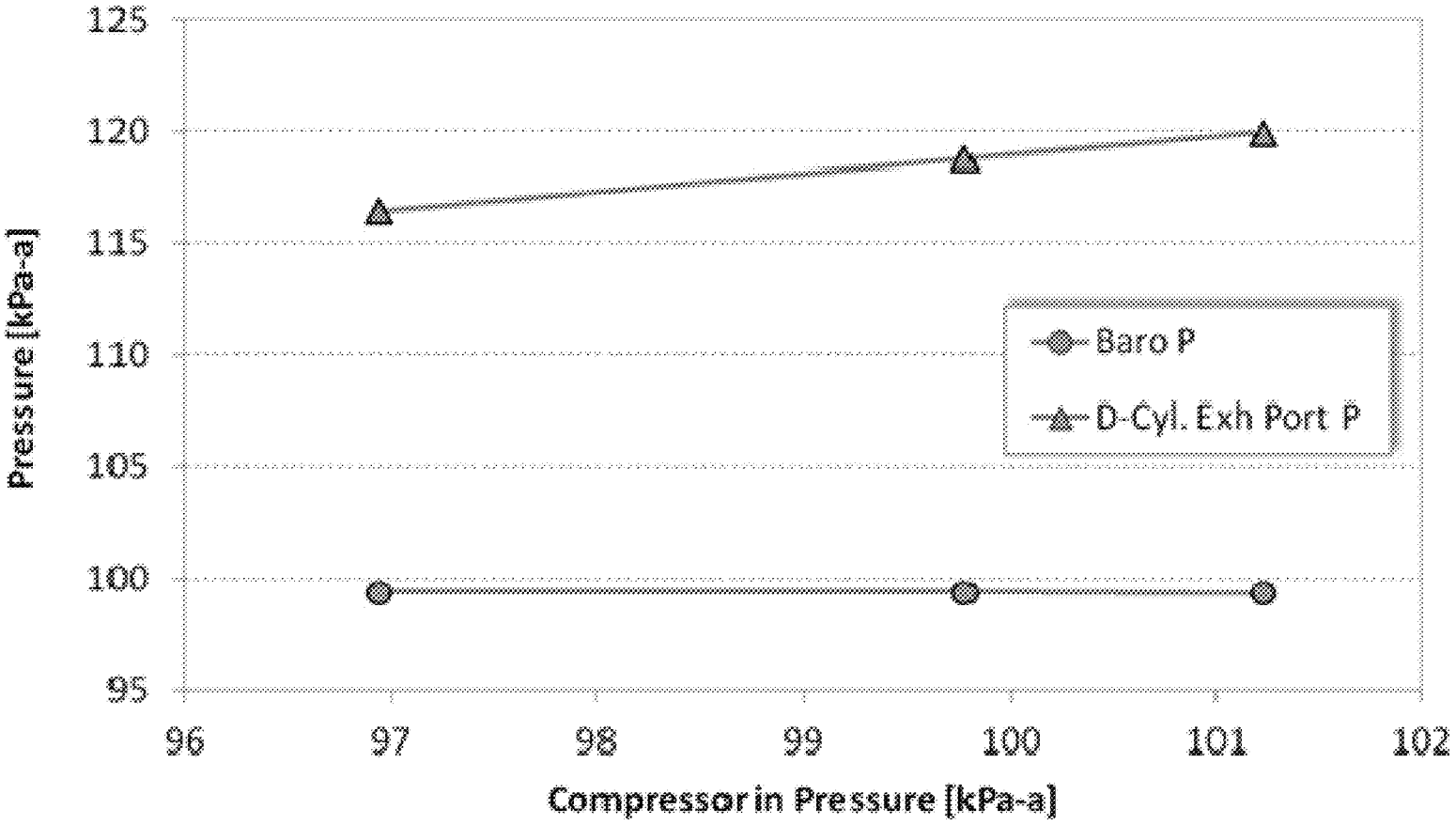

FIG. 3 identifies barometric and dedicated cylinder exhaust port pressure (D-Cyl. Exh. Port P) versus compressor-in pressure at 2000 rpm/2 bar BMEP.

Figure 4:
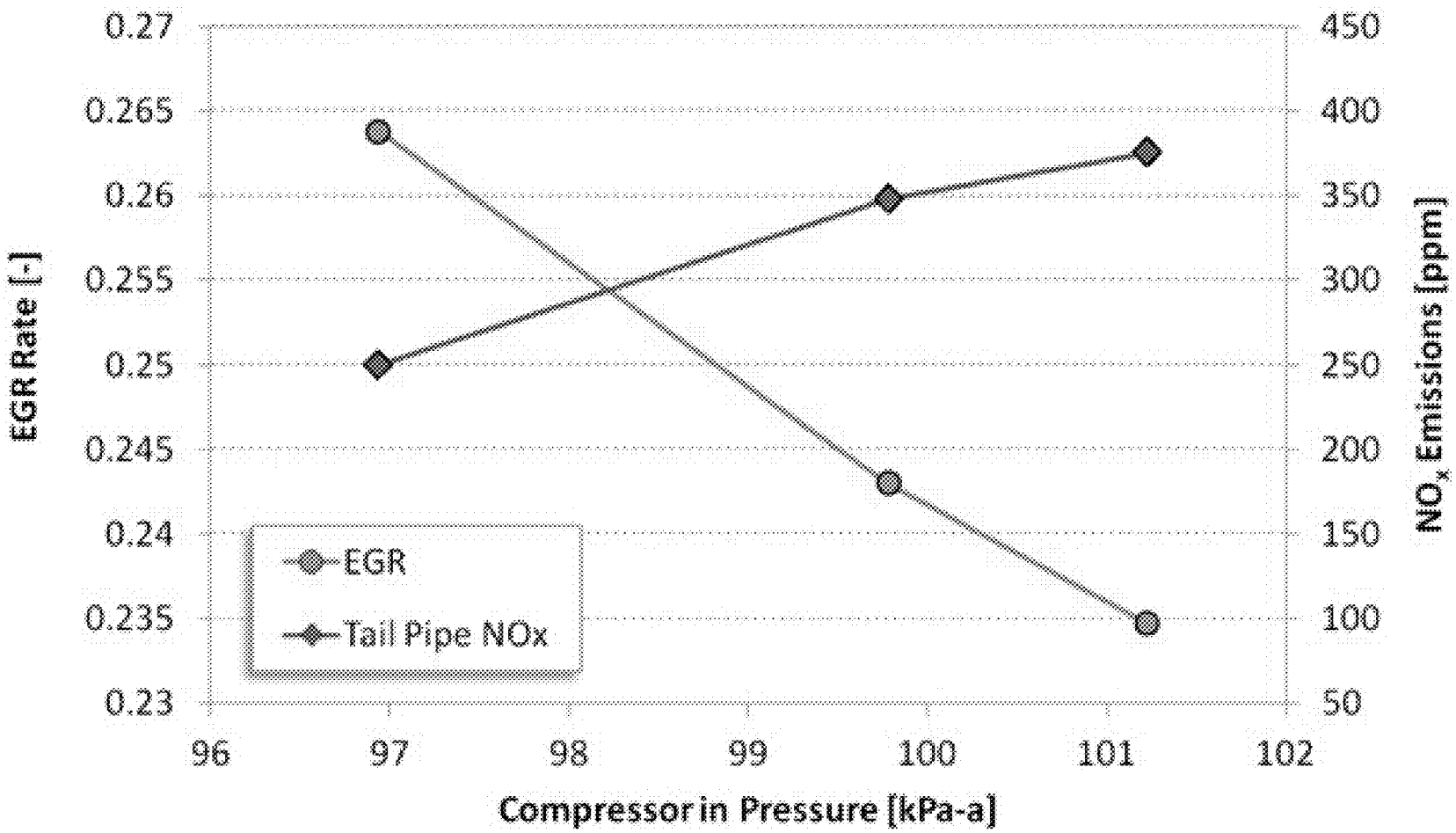
Figure 5:
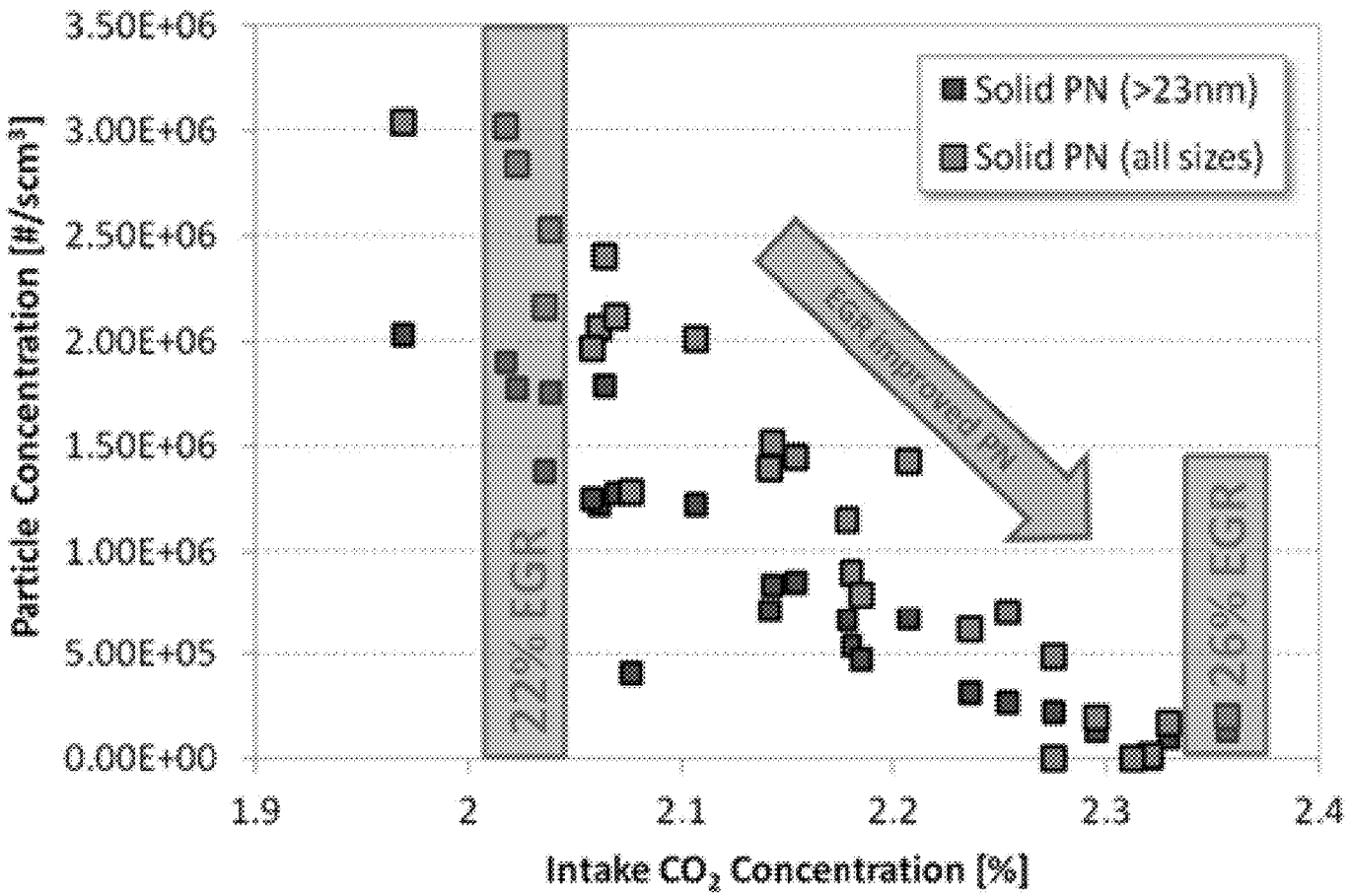

FIG. 4 is a plot of EGR rate and tail pipe NOx emissions versus compressor-in pressures at 2000 rpm and 2 bar BMEP FIG. 5 is a plot which identifies the impact of intake $CO_2$ concentration and EGR rate on particle matter.

Figure 6:
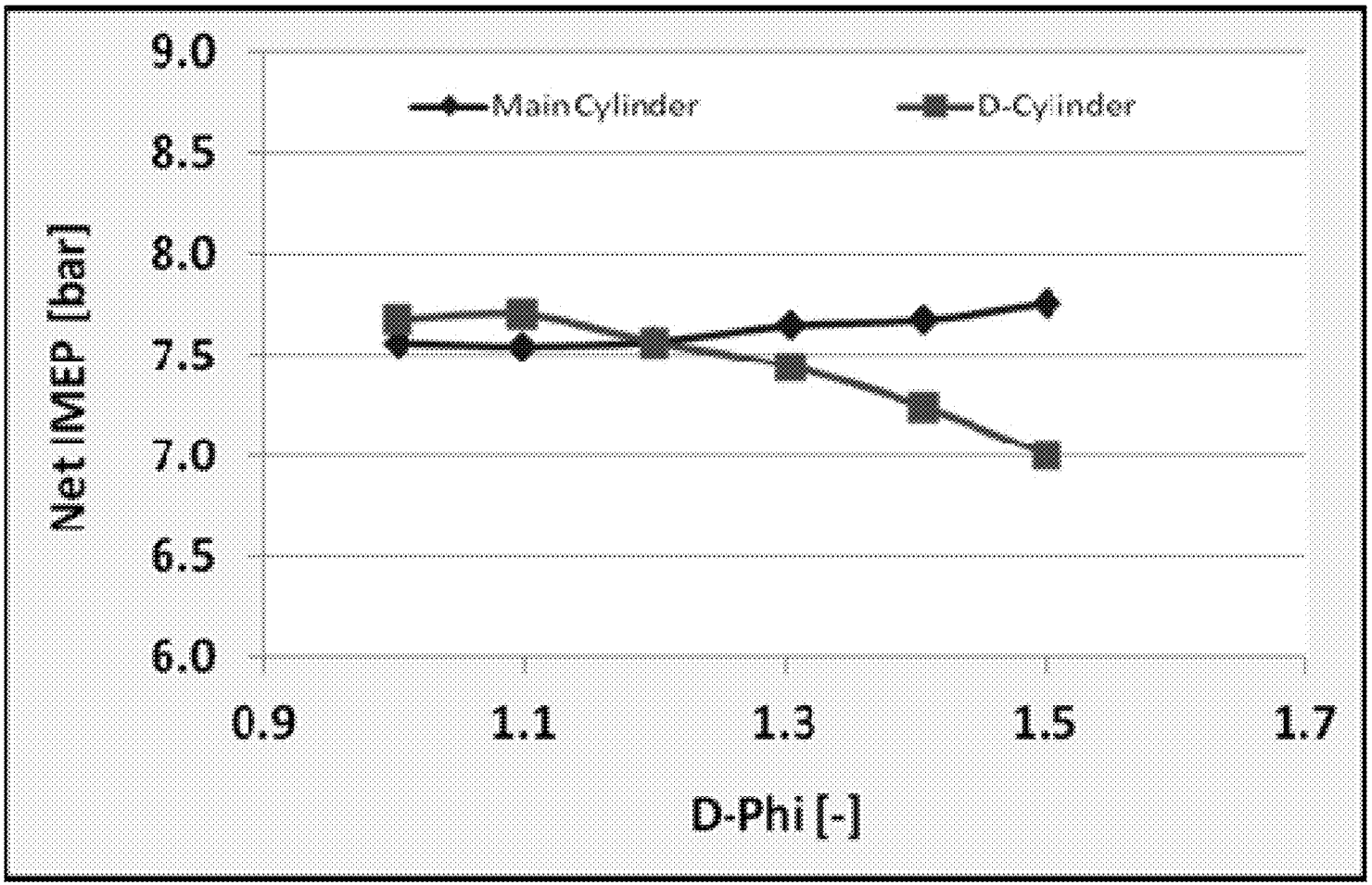

FIG. 6 is a plot which identifies main and dedicated EGR cylinder net IMEP as a function of dedicated exhaust gas recirculating cylinder equivalence ratio (D-Phi(−)) at 1500 rpm/6.7 bar BMEP.

Figure 7:
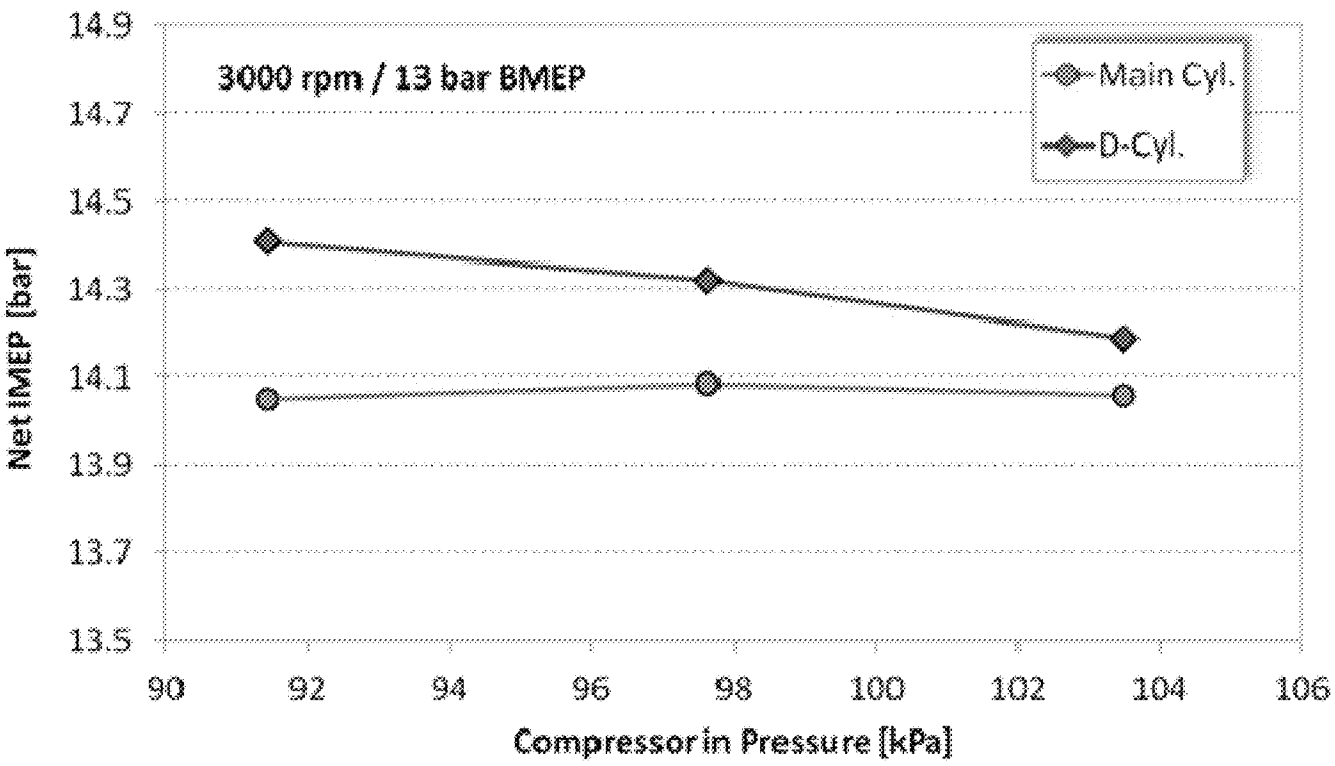

FIG. 7 is a plot which identifies main and D-EGR cylinder net IMEP as a function of compressor-in pressure at a constant D-EGR equivalence ratio of 1:1.

DETAILED DESCRIPTION OF PREFERRED EMBODIMENTS

Figure 1:
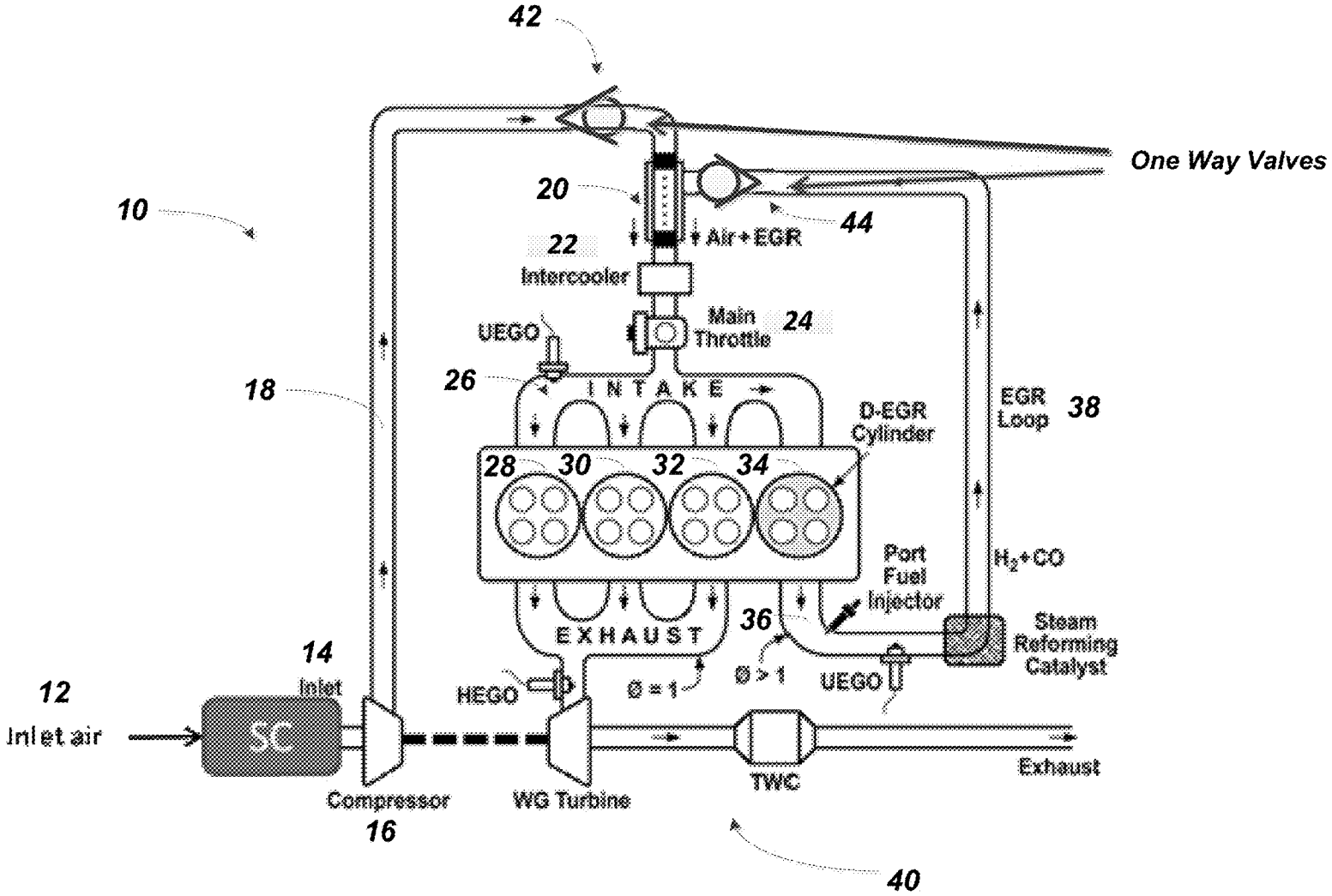
FIG. 1 is a schematic representation of an internal combustion engine having an emission system, particularly an EGR system.
Figure 1A:
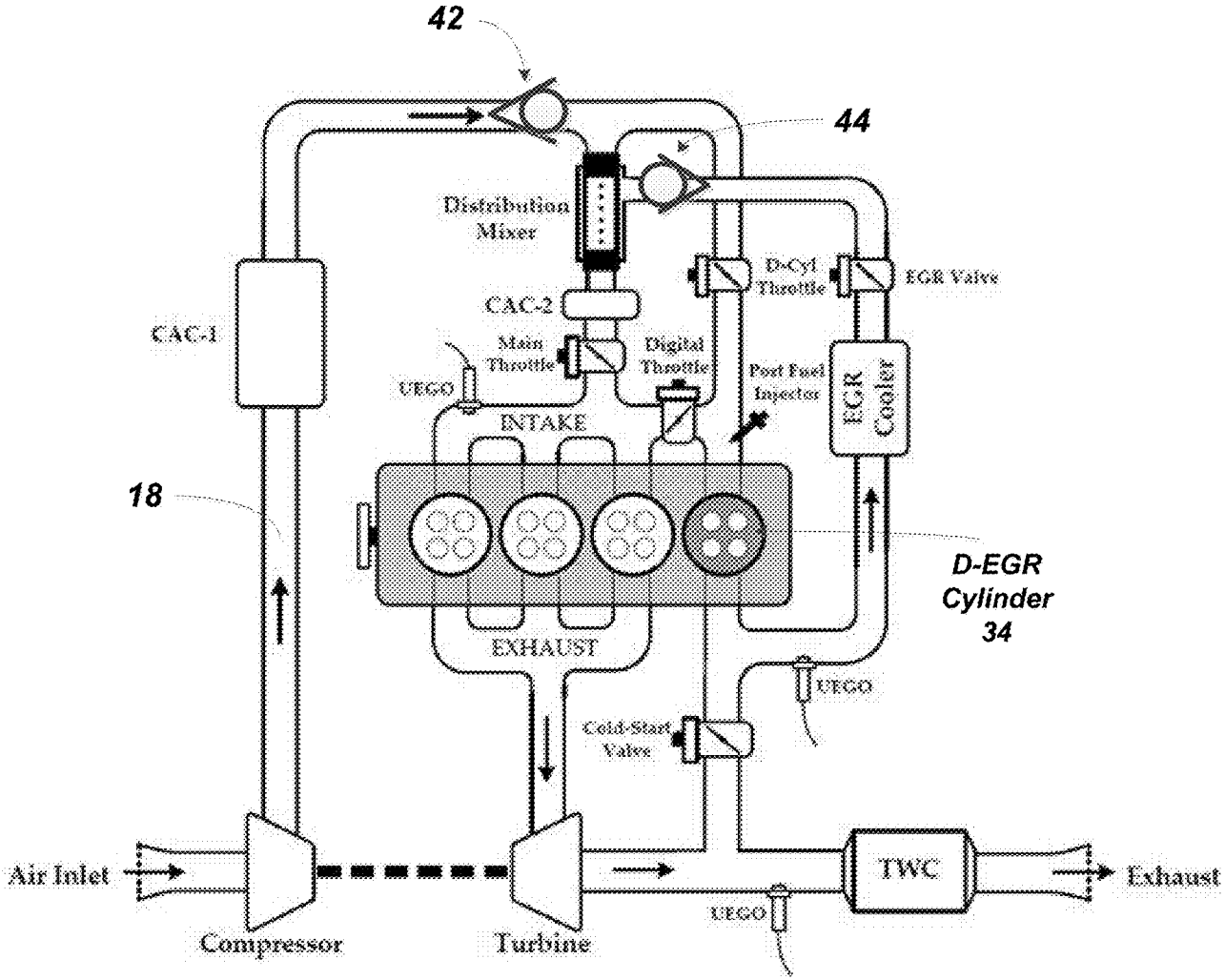
FIG. 1A is a schematic representation of an internal combustion engine have an emission system, particular an EGR system, where the EGR cylinder is also connected to the air intake passage.

Preferred configurations of the present invention is provided in FIGS. 1 and 1A which illustrates a dedicated exhaust gas recirculating (D-EGR) engine configuration. As can be observed, the D-EGR configuration is identified generally at 10 and identifies the preferred flow path for inlet air 12 introduced at inlet 14 which may be compressed be compressor 16 and travel within air intake passage 18. Other features of the engine include an air and exhaust gas mixer at 20, a cooler 22 which may be used to cool the air/exhaust gas mixture and the main throttle at 24. An intake manifold can be seen generally at 26 along with four cylinders 28, 30, 32, 34, although such is not intended to limit the present disclosure. In addition, the D-EGR configuration 10 includes a WG turbine, a uniform exhaust gas oxygen sensor (UEGO), a heat exhaust gas oxygen sensor (HEGO), three-way catalytic converter (TWC) downstream of the turbine and a steam reforming catalyst module for treatment of the exhaust gas in the EGR loop. SC refers to the optional use of a super-charger.

One of the cylinders 34 is identified as a dedicated exhaust gas recirculating (D-EGR) cylinder. In other words, it may be understood that the exhaust gas 36 expelled from cylinder 34 may be directed (recirculated) back to the intake system 26 through an EGR feedback loop 38. The feedback loop 38 may therefore be understood as a pathway, preferably provided by piping, for the exhaust gas to travel on its way to the air and exhaust gas mixer 20. The exhaust gas from the three cylinders 28, 30, and 32 is directed to an exhaust system 40. It is noted that on a volume basis, 90% or more of the exhaust gas expelled from D-EGR cylinder 34 is recirculated into the engine intake system 26. More preferably 90-100% by volume of exhaust gas expelled from D-EGR cylinder 24 is recirculated, including all values therein, in 0.1% increments.

As can be seen, one way values may now be preferably located in the air inlet shown generally at 42 and/or in the EGR loop shown generally at 44, as shown in both FIGS. 1 and 1A. It is noted that FIG. 1A shows what is understood as a split manifold intake to the D-EGR cylinder. That is, the D-EGR cylinder in FIG. 1A is one that is also connected to the air intake passage 18.

Accordingly, in the present invention, with the respect to the use of an engine configuration containing a D-EGR cylinder, the present invention is directed at the placement of a one-way valve in air intake passage for the engine, or a one-way valve in the EGR loop, or the combined use of such one-way valves to provide for more efficient engine operation.

Turning to one-way valve 42, it can now be appreciated that one preferred feature of a D-EGR engine is to re-introduce all of its high quality EGR gas (includes $H_2$ and CO) from the D-EGR Cylinder(s) back into the engine intake via the EGR distribution mixer shown generally at 20. The relatively high quality EGR gas can then preferably provide engine efficiency benefits through burn rate, combustion stability, heat transfer, pumping work, and knock resistance improvements. However, it was recognized herein that the high quality EGR gas can also back flow into the engine intake passing through the turbocharger compressor and inhibiting the fresh air flow into the engine. As a result, compressor efficiency decreased leading to a reduced engine load and efficiency potential.

Via use of the one-way valve 42 positioned in the air intake passage, the exhaust gas backflow into the air intake passage mentioned above can be reduced or avoided. More specifically, the amount of exhaust gas backflow introduced into the air intake passage 18 is now preferably reduced herein to a level in the range of 0 to 100% by volume, more preferably 0 to 5.0% by volume, and even more preferably to the range of 0 to 2.5%, and in a highly preferred embodiment, to the range of 0 to 1.0% by volume. In addition, preferably, the one-way valve 42 herein is preferably a Reed one-way valve which is understood as a check valve to restrict the flow of fluids to a single direction.

Furthermore, the one-way valve 42 is also preferably positioned at a location that is in relative close proximity to that location where the exhaust gas is introduced to the air and exhaust gas mixer 20. That is, preferably, one-way valve 42 is positioned within 0 to 20.0 cm of the air and exhaust gas mixer 20, more preferably 0 to 10.0 cm, and even more preferably, 0 to 5.0 cm. It is noted that the air and exhaust gas mixer 20 may itself have a length in the range of 10.0 cm to 40.0 cm.

Figure 2:
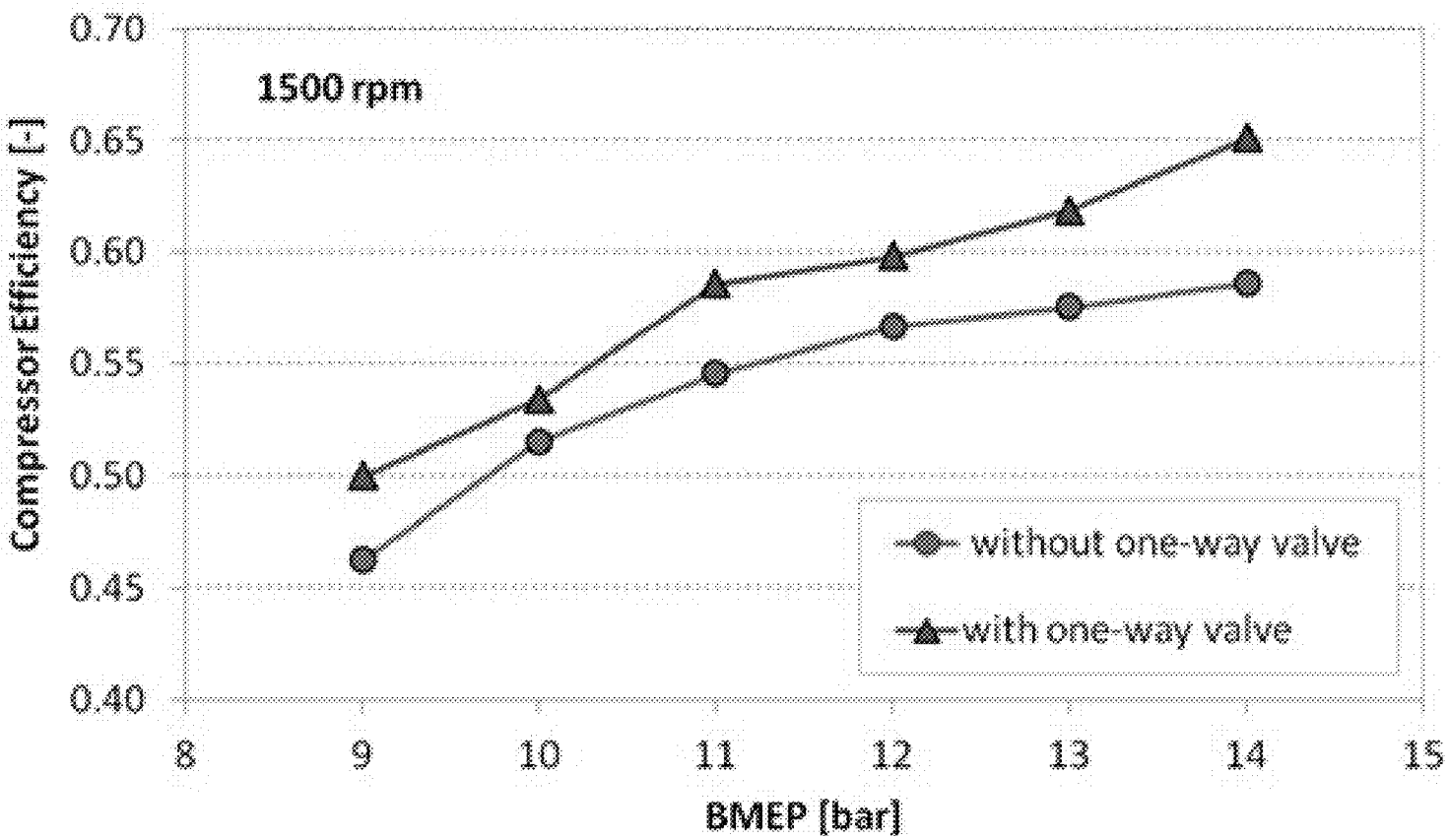
FIG. 2 is a graph of compressor efficiency versus brake mean effective pressure (BMEP) for a D-EGR engine both with and without one-way valve 42 as identified in FIG. 1.

At least one benefit to the introduction of one-way valve 42 is now shown in FIG. 2. As can be seen, operation of a D-EGR engine with and without one-way valve 42 was evaluated with respect to compressor efficiency, which is provided by the following relationship:

$$\eta_c = \frac{\left(\frac{P_{out}}{P_{in}}\right)^{\left(\frac{\gamma-1}{\gamma}\right)} - 1}{\frac{T_{out}}{T_{in}} - 1}$$

wherein $\eta_c$ stands for compressor efficiency, $P_{out}$ is compressor out pressure, $P_{in}$ is compressor-in pressure, $\gamma$ is the heat capacity ratio (heat capacity at constant pressure ($C_p$) to heat capacity at constant volume ($C_v$), which has a value of 1.4 for air, $T_{out}$ is the compressor out temperature and Tin is the compressor in temperature. Such compressor efficiency was observed to be relatively higher at all identified levels of brake mean effective pressure (BMEP) for the engine, which is reference to the average (mean) pressure which, if imposed on the pistons uniformly from the top to the bottom of each power stroke, would produce the measured (brake) power output.

Furthermore, it can also be appreciated that a back flow of EGR gas (in the absence of one-way valve 42) will inhibit the induction of fresh air mass and therefore negatively impact the volumetric efficiency (VE) of the engine. The VE of the engine is reference to the ratio of the mass density of the air-fuel mixture drawn into the cylinder at atmospheric pressure (during the intake stroke) to the mass density of the same volume of air in the intake manifold. In accordance with the use of one-way valve 42, the volumetric efficiency of the D-EGR engine may be up to 5.0%.

Attention is next directed to one-way valve 44 as shown in FIG. 1. Preferably, one-way valve 44 is a Reed valve and is also preferably positioned within 0 to 20.0 cm of the air and exhaust gas mixer 20, more preferably 0 to 10.0 cm, and even more preferably, 0 to 5.0 cm.

It can therefore now be appreciated that for D-EGR engine applications without the one-way valves disclosed herein, relatively fresh, compressed air was found to back flow into the D-EGR cylinder exhaust circuit instead of going straight into the intake manifold, compromising engine performance. This is especially true during those engine cycles where the D-EGR cylinder does not fire and expel its exhaust gases. As a result, the D-EGR cylinder exhaust process was found to be inhibited. However, in the broad context of the present invention, placement of one-way valve 44 in the EGR loop has now been found to reduce or eliminate the level of backflow of the relatively fresh compressed intake air into the EGR loop. More specifically, the amount of intake air backflow introduced into the EGR loop 38 is now preferably reduced herein to a level in the range of 0 to 10.0% by volume, more preferably 0 to 5.0% by volume, and even more preferably to the range of 0 to 2.5%, and in a highly preferred embodiment, to the range of 0 to 1.0% by volume.

FIG. 3 next shows how changes in compressor in pressures (or boost level, or ambient pressure changes) cause an increase in D-EGR cylinder exhaust port pressures and thus increased pumping work. More specifically, FIG. 3 identifies barometric and dedicated cylinder exhaust port pressure (D-Cyl. Exh. Port P) versus compressor-in pressure at 2000 rpm/2 bar BMEP. Accordingly, the increased D-EGR cylinder pumping work led to a reduction in EGR rate as shown in FIG. 4, which is a plot of EGR rate and tail pipe NOx emissions versus compressor-in pressures at 2000 rpm and 2 bar BMEP. EGR rate is reference to intake $CO_2$ measurement divided by D-EGR cylinder exhaust $CO_2$ measurement. Such reduced level of relatively high quality EGR in turn was observed to cause an increase in engine-out nitrous oxides ($NO_x$) as shown in FIG. 4 and an increase in particle emissions as shown in FIG. 5. In FIG. 5, particle concentration is identified as the number of particles per standard cubic meter ($scm^3$).

Furthermore, the reduced high quality EGR led to a decrease in the aforementioned benefits of D-EGR such as heat transfer losses, combustion efficiency, burn rates, etc. Additionally, the increased D-EGR cylinder exhaust port pressures led to relatively poor scavenging which may result in up to 10% increased hot residual gasses and thus increased combustion instabilities (coefficient of variation (COV) of IMEP may decrease by up to 2 percentage points) as well as a decrease in knock resistance of this cylinder. The reduced knock resistance in the D-EGR cylinder may enable up to 5 crank angle degrees (CAD) combustion phasing advance.

Moreover, the increased D-EGR cylinder pumping work also magnifies the indicated mean effective pressure (IMEP) balancing challenge with a D-EGR engine. Since the EGR cylinder is typically operated at D-Phi≥1.25, or in the range of 1.25 to 1.8, where D-Phi is the dedicated exhaust cylinder equivalence ratio, the IMEP decreases compared to the stoichiometric operated cylinders, leading to the IMEP imbalance as shown in FIG. 6. If the inlet and/or boost pressure is now increased, the D-EGR cylinder IMEP will further decrease in comparison to the main cylinders as shown in FIG. 7. Since a relatively large IMEP imbalance of more than 10% cannot be tolerated from a mechanical and NVH perspective, the efficiency of a D-EGR engine may be limited. Especially at highly boosted conditions, that is intake manifold pressure>150 kPa-a, a fresh air back flow in the D-EGR cylinder will cause a decrease in D-EGR cylinder IMEP and trapped residuals and require the decrease in D-EGR cylinder over-fueling and thus engine efficiency and stability.

Finally, the use of both one-way valves 42 and 44 has shown to reduce the relatively large intake pressure fluctuations (without one-way valve: up to ±10 kPa, with one-way valve up to ±2 kPa) caused by constructive interference of back flowing D-EGR pulses with fresh air pulses. Such large intake pressure fluctuations can lead to the inability to efficiently utilize an intake manifold air pressure sensor (MAP), mass air flow sensor (MAF), or an intake oxygen sensor for engine control and diagnostic purposes. In addition, the reduced pressure fluctuations with the one-way valves are contemplated to enable a 0-50% smaller D-EGR mixer, and/or reduced D-EGR cylinder exhaust and intake plumbing by up to 50% since the large volumes (greater than 4 times the engine displacement) are no longer required for the pressure attenuation effect.

What is claimed is:

1. An internal combustion engine comprising an air intake passage in communication with an intake manifold including a plurality of cylinders, at least one of the cylinders arranged as a dedicated exhaust gas recirculation cylinder, wherein a volume of exhaust gas expelled from the dedicated exhaust gas cylinder is capable of recirculating via an exhaust gas recirculation loop to said intake manifold, including a first one-way valve positioned in said air intake passage and a second one-way valve positioned in said exhaust gas recirculation loop, wherein said first one-way valve positioned in said air intake passage is capable of restricting the flow of exhaust gas from said exhaust gas recirculation loop into said air intake passage and said second one-way valve positioned in said exhaust gas recirculation loop is capable of restricting the flow of air from said air intake passage into said exhaust gas recirculation loop.

2. The internal combustion engine of claim 1 wherein said dedicated exhaust gas recirculation cylinder is connected to said air intake passage.

3. The internal combustion engine of claim 1 wherein said first one-way valve positioned in said air intake passage restricts backflow of said exhaust gas from entering into said air intake passage.

4. The internal combustion engine of claim 1 wherein said first one-way valve positioned in said air intake passage restricts a backflow of 0 to 5.0% by volume of exhaust gas from said exhaust gas recirculation loop from entering into said air intake passage.

5. The internal combustion engine of claim 1 wherein said second one-way valve positioned in said exhaust gas recirculation loop restricts a backflow of air from entering into said exhaust gas recirculation loop.

6. The internal combustion engine of claim 1 wherein said one-way valve positioned in said exhaust gas recirculation loop restricts a backflow of 0 to 10.0% by volume of air from entering into said exhaust gas recirculation loop.

7. An internal combustion engine comprising an air intake passage in communication with an intake manifold including a plurality of cylinders, at least one of the cylinders arranged as a dedicated exhaust gas recirculation cylinder, wherein a volume of exhaust gas expelled from the dedicated exhaust gas cylinder is capable of recirculating via an exhaust gas recirculation loop to said intake manifold, including a first one-way valve positioned in said air intake passage and a second one-way value positioned in said exhaust gas recirculation loop, wherein said first one-way valve positioned in said air intake passage is capable of restricting a backflow of 0-10% by volume of exhaust gas from said exhaust gas recirculation loop into said air intake passage and said second one-way valve positioned in said exhaust gas recirculation loop is capable of restricting a backflow of 0-10% by volume of air from said air intake passage into said exhaust gas recirculation loop.

8. The internal combustion engine of claim 7 wherein said dedicated exhaust gas recirculation cylinder is connected to said air intake passage.

9. A method of operating an internal combustion engine having a plurality of cylinders, an air-intake passage and an exhaust gas recirculation loop, including a first one-way valve positioned in said air-intake passage and a second one-way valve positioned in said exhaust gas recirculation loop, comprising:

operating one or more of said cylinder(s) as a non-dedicated exhaust gas recirculating cylinder which non-dedicated exhaust gas cylinder(s) is in communication with said air-intake passage;

operating one or more cylinders as a dedicated exhaust gas recirculating cylinder wherein said operation provides exhaust gas output that is connected to said exhaust gas recirculation loop;

wherein said first one-way valve positioned in said air intake passage restricts the flow of exhaust gas from said exhaust gas recirculation loop into said air intake passage and said second one-way valve positioned in said exhaust gas recirculation loop restricts the flow of air from said air intake passage into said exhaust gas recirculation loop.

10. The method of claim 9 wherein said internal combustion is operated at a dedicated exhaust gas cylinder equivalence ratio of greater than or equal to 1.25.

11. The internal combustion engine of claim 8 wherein said internal combustion engine is operated at a dedicated exhaust gas cylinder equivalence ratio of greater than or equal to 1.25.

12. The method of claim 9 wherein said dedicated exhaust gas recirculation cylinder is connected to said air intake passage.

* * * * *